US006247894B1

(12) United States Patent
Moody et al.

(10) Patent No.: US 6,247,894 B1
(45) **Date of Patent: *Jun. 19, 2001**

(54) CEILING FAN WITH INTEGRAL UP-LIGHT

(75) Inventors: John Moody, Bunker Hill, IL (US); Stanfield Young, Cypress, CA (US); David Lathrop, Edwardsville, IL (US)

(73) Assignee: Emerson Electric Co., St. Louis, MO (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/956,302

(22) Filed: Oct. 22, 1997

(51) Int. Cl.[7] ..... F04D 29/32; F04D 29/34

(52) U.S. Cl. ..... 416/5; 416/170 R; 416/210 R; 416/212 R; 416/214 R; 416/220 A; 362/96; 362/234

(58) Field of Search ..... 416/5, 170 R, 416/202, 210 R, 212 R, 214 R, 219 A, 220 A, 222, 244 R; 417/423.14; 362/96, 234

(56) References Cited

U.S. PATENT DOCUMENTS

| | | | | |
|---|---|---|---|---|
| 1,260,562 | * | 3/1918 | McIntosh | 416/212 R |
| 1,940,318 | * | 12/1933 | Morse | 416/5 |
| 2,535,527 | * | 12/1950 | Barkley | 416/212 R |
| 2,581,872 | * | 1/1952 | Morrison | 416/212 R |
| 5,151,011 | | 9/1992 | Rezek | 416/5 |
| 5,349,513 | * | 9/1994 | Taylor III, et al. | 416/5 |
| 5,440,459 | * | 8/1995 | Chan | 362/96 |
| 5,462,412 | * | 10/1995 | Scofield et al. | 416/210 R |

FOREIGN PATENT DOCUMENTS

| | | | | |
|---|---|---|---|---|
| 242977 | * | 1/1926 | (GB) | 416/214 R |
| 140546 | | 3/1990 | (TW) . | |
| 241840 | | 2/1995 | (TW) . | |

* cited by examiner

*Primary Examiner*—Christopher Verdier
(74) *Attorney, Agent, or Firm*—Howrey Simon Arnold & White, LLP

(57) ABSTRACT

A ceiling fan includes a motor including a stator having an upper portion and a rotor having a lower portion, the rotor being rotatable with respect to the stator. A plurality of blade holders each form an interlocking segment of a motor-concealing member such that the motor concealing member rotates about the motor. A plurality of fan blades equal in number to the blade holders are attached to the ledge such that the fan blade extends radially from the hub. A plurality of light sockets are coupled to the stator upper portion for engaging light bulbs.

28 Claims, 7 Drawing Sheets

CEILING FAN WITH INTEGRAL UP-LIGHT

BACKGROUND OF THE INVENTION

1. FIELD OF THE INVENTION

The invention relates generally to ceiling fans, and more particularly, to ceiling fans having an up-light and an improved blade holding system.

2. DESCRIPTION OF RELATED ART

Electric ceiling fans are commonly used to provide improved circulation in a room and assist heating and air conditioning systems. Known ceiling fans generally consist of an electric motor suspended by a shaft or down rod from a ceiling. Other ceiling fan styles are mounted such that there is little or no clearance between the top of the motor and the ceiling. These ceiling fans are known as "snugger" or "zero-clearance" fans, and are used where floor to ceiling clearance is too small for suspending the fan motor with a down rod. The motor includes a stationary portion (the stator) and a rotating portion (the rotor). A decorative housing surrounds the motor, with an opening provided in the lower portion of the housing to allow a plurality of blades to be mounted to the rotating portion. Conventional ceiling fans typically incorporate one or more electrical switches encased within a switch housing beneath the motor for controlling the speed and rotational direction of the blades.

Known ceiling fans often have light fixtures attached to the bottom portion of motor, below the blades. In many applications, the light fixture is mounted to the switch housing below the fan blades, with the light fixture lamps casting illumination in a downward fashion. In many applications, however, it is desirable to provide indirect lighting, such as casting light upwards toward the ceiling above the fan. Unfortunately, with conventional ceiling fans, it is often impossible to provide this type of indirect lighting.

For example, many conventional ceiling fans are constructed only to allow connecting a light fixture to the bottom of the motor or switch housing. There is no connection means provided at the top portion of the motor. Even with ceiling fans adapted to receive existing up-light fixtures, there typically is not sufficient clearance between the top of the motor and the ceiling from which the ceiling fan is suspended.

Adding a light fixture that extends well above the top of the fan motor will usually place the light fixture too close to the ceiling to provide adequate lighting.

Often, there is inadequate space between the floor and ceiling to extend the down rod to provide the additional clearance required for known up-light fixtures. Ceiling fan blades situated too far below the ceiling may cause a hazard to out-stretched arms or other items carried or placed above a person's head, for example. Moreover, even when indirect lighting, such as up-lighting, is desired, there may also be a need for the conventional down-lights associated with ceiling fans. This only adds to the clearance problem, as the increased ceiling clearance in combination with the up-light fixture, the ceiling fan itself, and the down-light fixture results in lighting that hangs too close to the floor.

Another shortcoming associated with known ceiling fans is the manner in which the fan blades are attached to the rotor. A prior art blade flange with a fan blade attached thereto is illustrated in FIG. 1. The blade flange 1 includes a first end 2 which is in an overlapping relationship with the fan blade 3. The blade 3 is screwed or bolted to the blade flange 1. A second end of the blade flange 1 is bolted to the lower surface of a rotating member, which is connected to the rotor. Connecting the blade 3 to the blade flange 1 in this manner often results in the fan blades being out of balance, causing the fan to sway or wobble.

Contributing to this problem is the manner in which the blade flange is attached to the rotating member. Since the decorative housing is required to hide the fan motor, the blades must connect to the rotating member bottom surface. As shown in the prior art blade flange 1 in FIG. 1, the second end 4 which is coupled to the rotating member is offset from the first end 2 connected to the fan blade 3. This allows the second end 4 to extend upwards within the decorative motor housing. Connecting the blade flanges to the bottom portion of the rotating member within the decorative motor housing can be a difficult task at best, and the stress of the blade on a conventional blade flange only adds to the balancing problem.

Thus, a need exists for an improved ceiling fan which includes an up-light feature which does not increase the required ceiling clearance. An improved blade holder for a ceiling fan is also needed to address the shortcomings of known blade flanges. The present invention addresses these and other shortcomings of the prior art.

SUMMARY OF THE INVENTION

In one aspect of the present invention, a ceiling fan includes a motor having a stator which has an upper portion, and a rotor which has a lower portion and is rotatable with respect to the stator. A hub is coupled to the lower portion of the rotor so as to rotate therewith. A plurality of blade holders are coupled to the hub, with each blade holder forming an interlocking segment of a motor-concealing member such that the motor concealing member rotates about the motor with the hub. A plurality of fan blades equal in number to the blade holders each have a first end, and each blade holder defines a ledge. The first end of one of the fan blades is attached to the ledge such that the fan blade extends radially from the hub and a plurality of light sockets are coupled to the stator upper portion for engaging light bulbs.

In another aspect of the invention, a blade-holding system for coupling fan blades to a ceiling fan which includes a motor having a rotating hub is presented. The blade-holding system includes a plurality of blade holders, each having a lower portion adapted to be coupled to the hub such that the blade holder rotates therewith. Each blade holder has an upper portion including first and second ends, the first end of each blade holder is adapted to be coupled to the second end of an adjacent blade holder, such that each blade holder forms an interlocking segment of a motor-concealing member which rotates about the motor with the hub. Each blade holder further defines a ledge adapted to receive one end of a fan blade such that the fan blades extend radially from the hub and is rotatable therewith.

In a further aspect of the invention, a light fixture is provided for a ceiling fan including a motor having a stator defining a top surface, a rotor having a plurality of blades attached thereto each having a distal end extending radially from the motor. The up-light fixture includes a light pan coupled to the top surface of the stator defining a circumferential trough and a plurality of light sockets for engaging light bulbs, with the sockets positioned within the trough.

BRIEF DESCRIPTION OF THE DRAWINGS

Other objects and advantages of the invention will become apparent upon reading the following detailed description and upon reference to the drawings in which.

Figure 1:
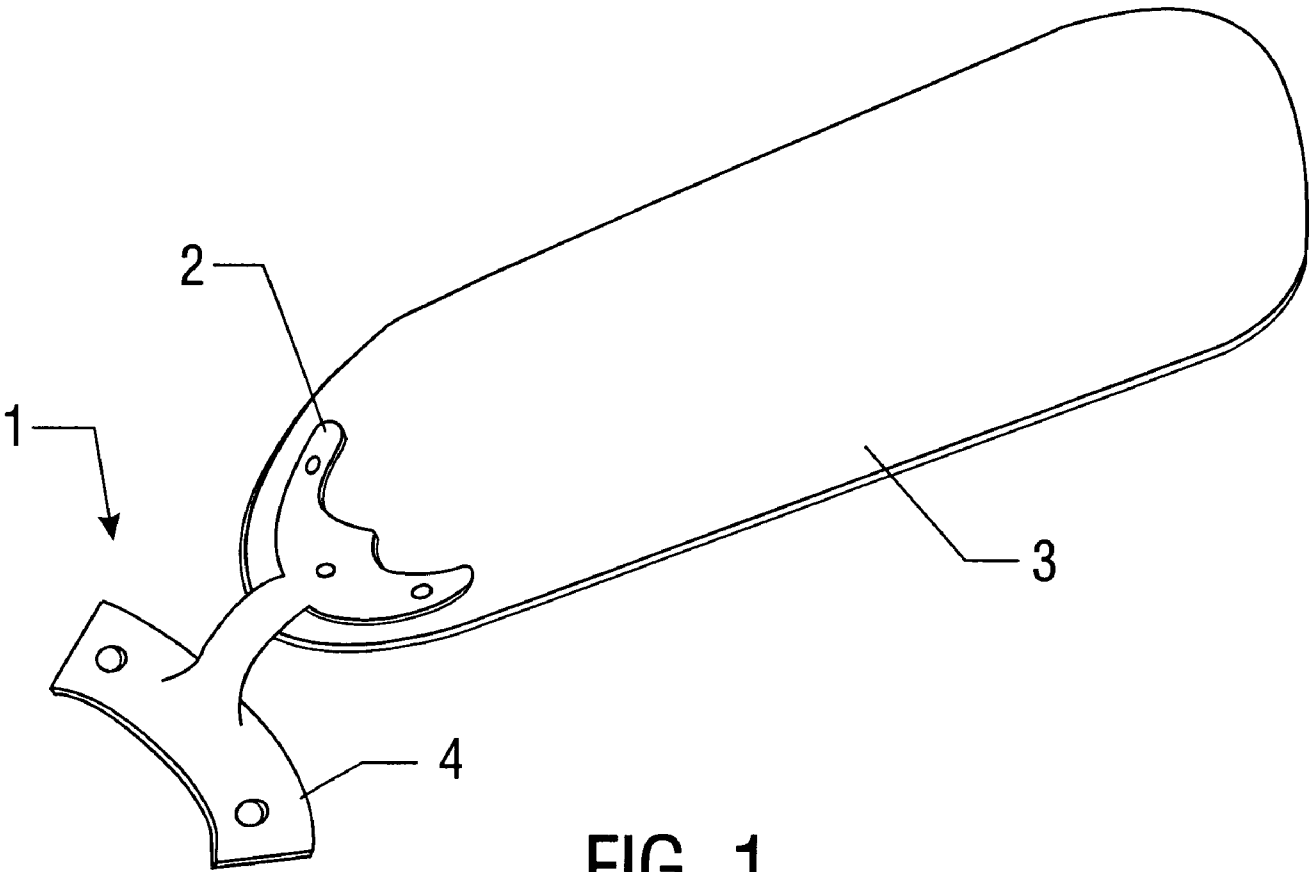
FIG. 1 (Prior Art)
FIG. 1 illustrates a prior art ceiling fan blade and blade flange.

While the invention is susceptible to various modifications and alternative forms, specific embodiments thereof have been shown by way of example in the drawings and are herein described in detail. It should be understood, however, that the description herein of specific embodiments is not intended to limit the invention to the particular forms disclosed, but on the contrary, the intention is to cover all modifications, equivalents, and alternatives falling within the spirit and scope of the invention as defined by the appended claims.

DETAILED DESCRIPTION OF THE INVENTION

Illustrative embodiments of the invention are described below. In the interest of clarity, not all features of an actual implementation are described in this specification. It will of course be appreciated that in the development of any such actual embodiment, numerous implementation-specific decisions must be made to achieve the developers' specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

Figure 2:
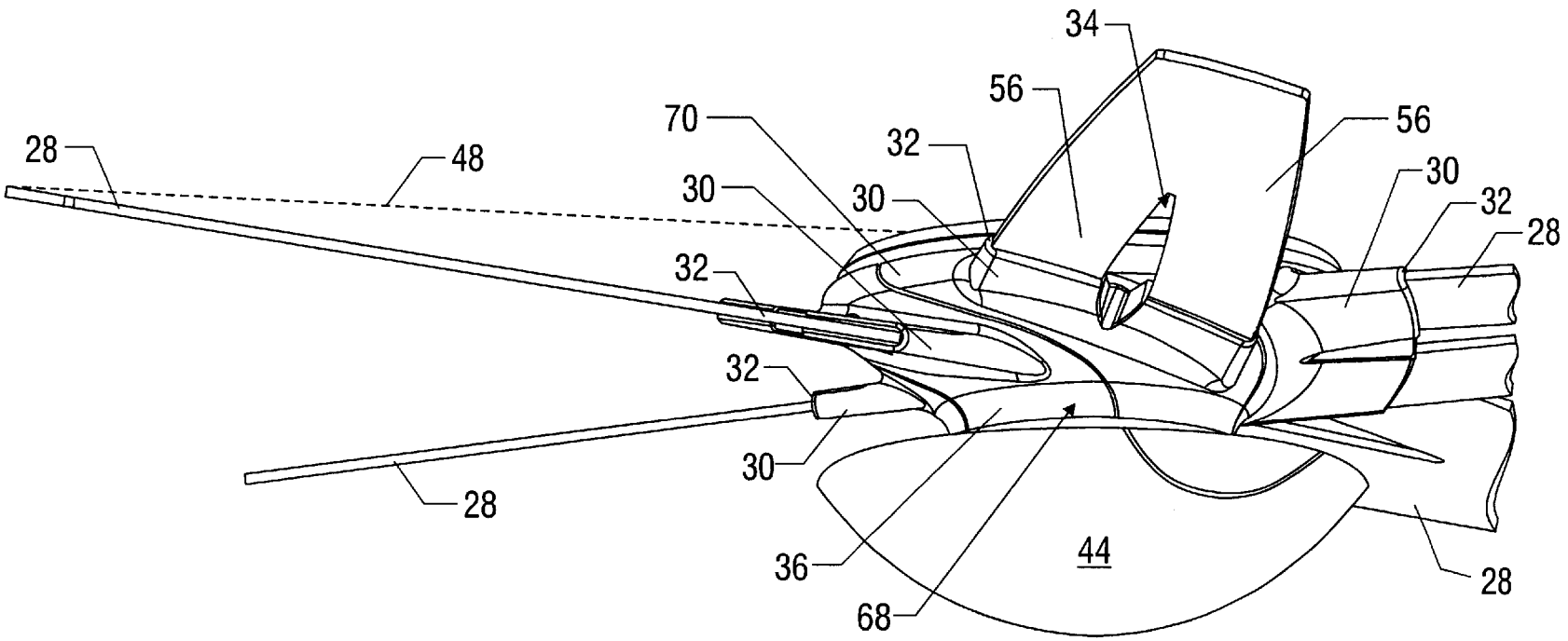
FIG. 2 is a perspective view of an exemplary embodiment of the novel ceiling fan of the present invention.
Figure 3:
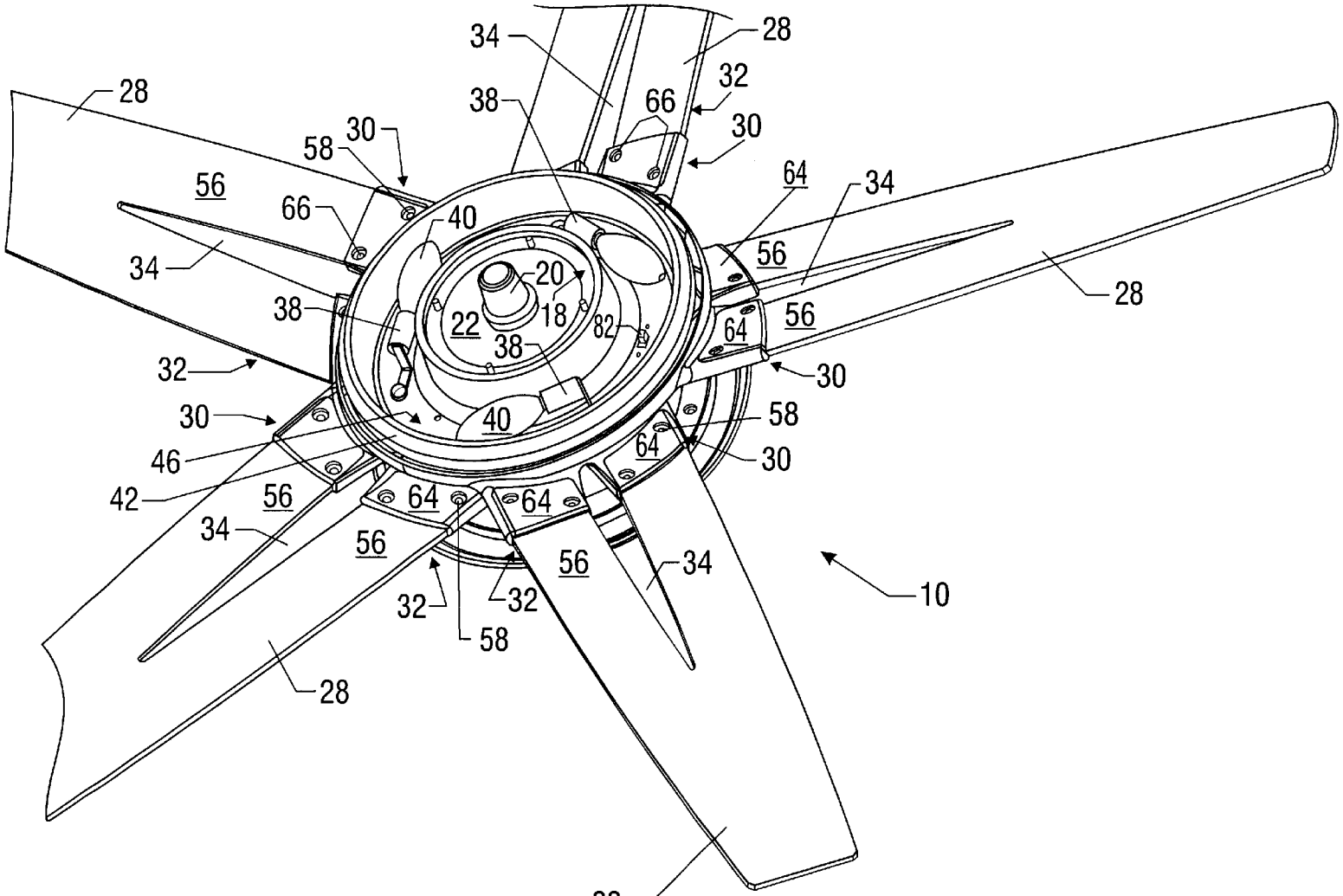
FIG. 3 is a perspective top view of the exemplary embodiment of the novel ceiling fan of the present invention.
Figure 4:
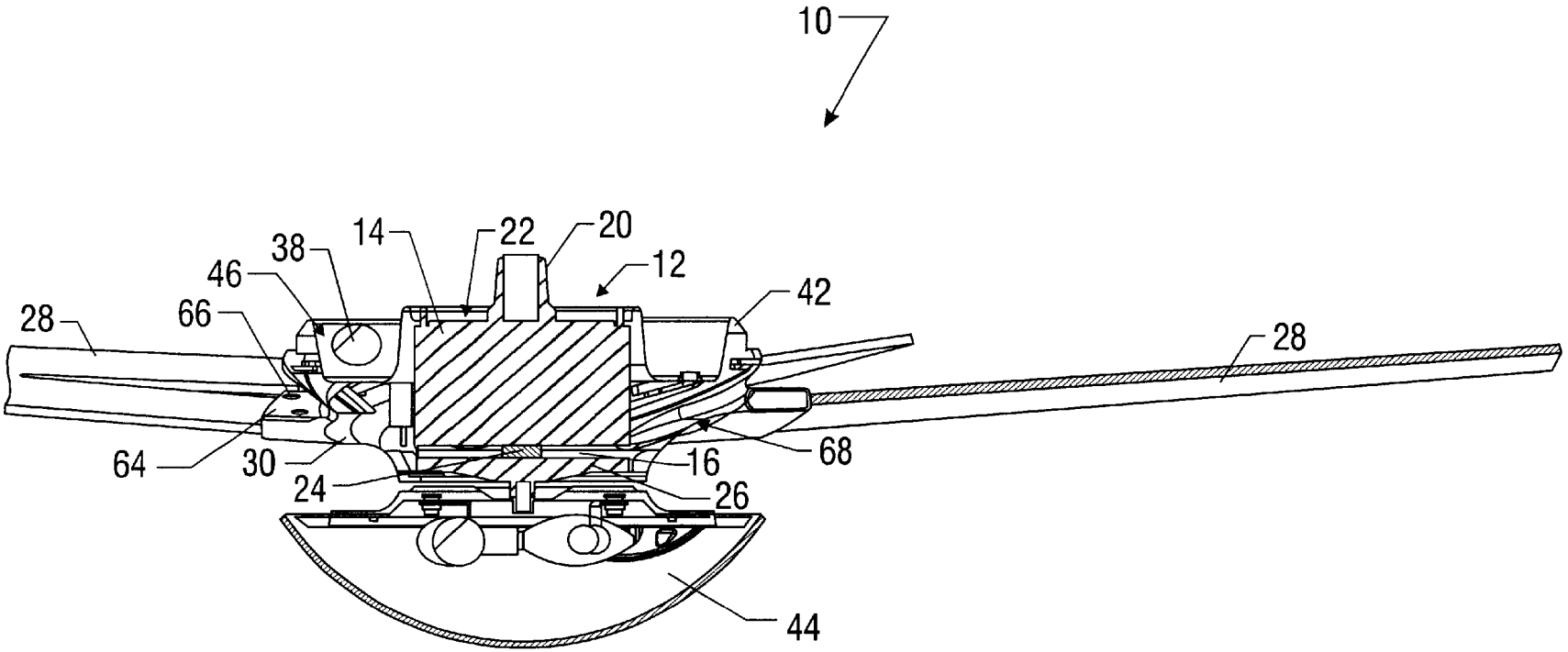
FIG. 4 is a cut-away elevation view of the exemplary embodiment of the novel ceiling fan of the present invention.

Turning to the drawings and in particular, FIG. 2, FIG. 3 and FIG. 4, an exemplary ceiling fan 10 constructed in accordance with the present invention is illustrated in various views. The ceiling fan 10 includes a motor 12 which has a stationary portion, or stator 14, and a rotor 16 which rotates relative to the stator. The stator 14 has an upper portion 18, to which a collar 20 is attached. A down rod (not shown) couples to the collar 20 for suspending the fan 10 from a ceiling. The rotor 16 includes a lower portion 24, to which a generally disc-shaped hub 26 is fixed so as to rotate with the rotor 16. In one embodiment, the hub 26 is fashioned of rubber.

The exemplary fan 10 further includes a plurality of fan blades 28 and a corresponding plurality of blade holders 30. The blade holders 30 may be made using a zinc die cast process. The embodiment pictured includes five fan blades 28 and five corresponding blade holders 30. The fan blades 28 include a first end 32, and one embodiment of the invention includes fan blades 28 having a "split" blade design, wherein the blade first end 32 defines a generally V-shaped cut-out 34. The blade holders 30 are coupled to the hub 26 so as to rotate therewith. In an embodiment of the invention, the hub 26 defines a plurality of threaded bores positioned around the periphery of the hub 26, with a series of corresponding bolts passing through openings in the lower portion 36 of the blade holders 30 and threaded into the hub 26 to couple the blade holders 30 to the hub 26.

The exemplary ceiling fan 10 further includes an integral "up-light" feature, which includes plurality of light sockets 38 coupled to the stator upper portion 18 for engaging light bulbs 40. In the embodiment pictured, the light sockets 40 are positioned within a light pan 42 coupled to the upper portion 18 of the stator 14 such that the illumination from the light bulbs 40 projects above the fan blades 30. The light pan 44 may be fashioned of stamped steel with a polished finish to reflect the light. Further, the light pan 42 may be further lined with a foil-faced insulator to further reflect the light away from the motor and also to reflect heat from the light bulbs 40.

In an embodiment of the invention, three light sockets 38 are positioned within the light pan 42, with three forty-watt incandescent light bulbs 40 engaged therein. Depending on the application, other types of light fixtures may be employed, such as a circular florescent lamp and associated fixture. The wiring for the light sockets 38 may be as in standard ceiling fans known in the art. The up-light feature of the exemplary ceiling fan 10 provides pleasant, indirect illumination, casting light upwards onto the ceiling rather than downwards towards the floor of a room. The ceiling fan 10 of the invention may optionally include an additional conventional lighting fixture 44, positioned below the motor 12. Since the exemplary ceiling fan illustrated in the drawings herein does not include a switch housing extending below the motor as in known ceiling fans, a threaded shaft may extend downward through the hub 26, to which a down-light kit may be connected and held in place with a threaded hub and a set screw.

In an embodiment of the invention, a remote control is provided which operates both the up-light feature and the optional conventional lighting fixture. The remote control may further control the fan blade 28 rotational speed and direction.

While many ceiling fan applications desire the indirect illumination provided by an up-light feature as in the present invention, the limited floor to ceiling distance in many rooms prevents its implementation with known up-light designs. With prior art ceiling fans, up-light fixtures are positioned above the fan motor. This increases the distance required between the fan motor and the ceiling. A conventional light fixture additionally positioned below the fan blades may hang dangerously far below the ceiling, creating a hazard, due to the combined distance of the down rod, up-light fixture, ceiling fan assembly, and down light fixture.

This problem is addressed in the present invention by coupling the up-light sockets 38 directly to the fan motor 12. The light pan 42 defines a circumferential trough 46 in which the sockets 38 are positioned. The light pan 42 is coupled to the top surface 22 of the motor stator 14, with the trough 46 situated relative to the stator 14 such that the light sockets 38 are located below the plane of the top surface 22. Moreover, as seen in FIG. 2, the trough 46 may be situated relative to the stator 14 such that at least a portion of each light socket 38 is located below a horizontal plane (reference number 48) defined by the fan blade tips. Thus, the integral up-light feature provides the desirable upwards illumination without requiring any additional ceiling clearance.

Figure 5:
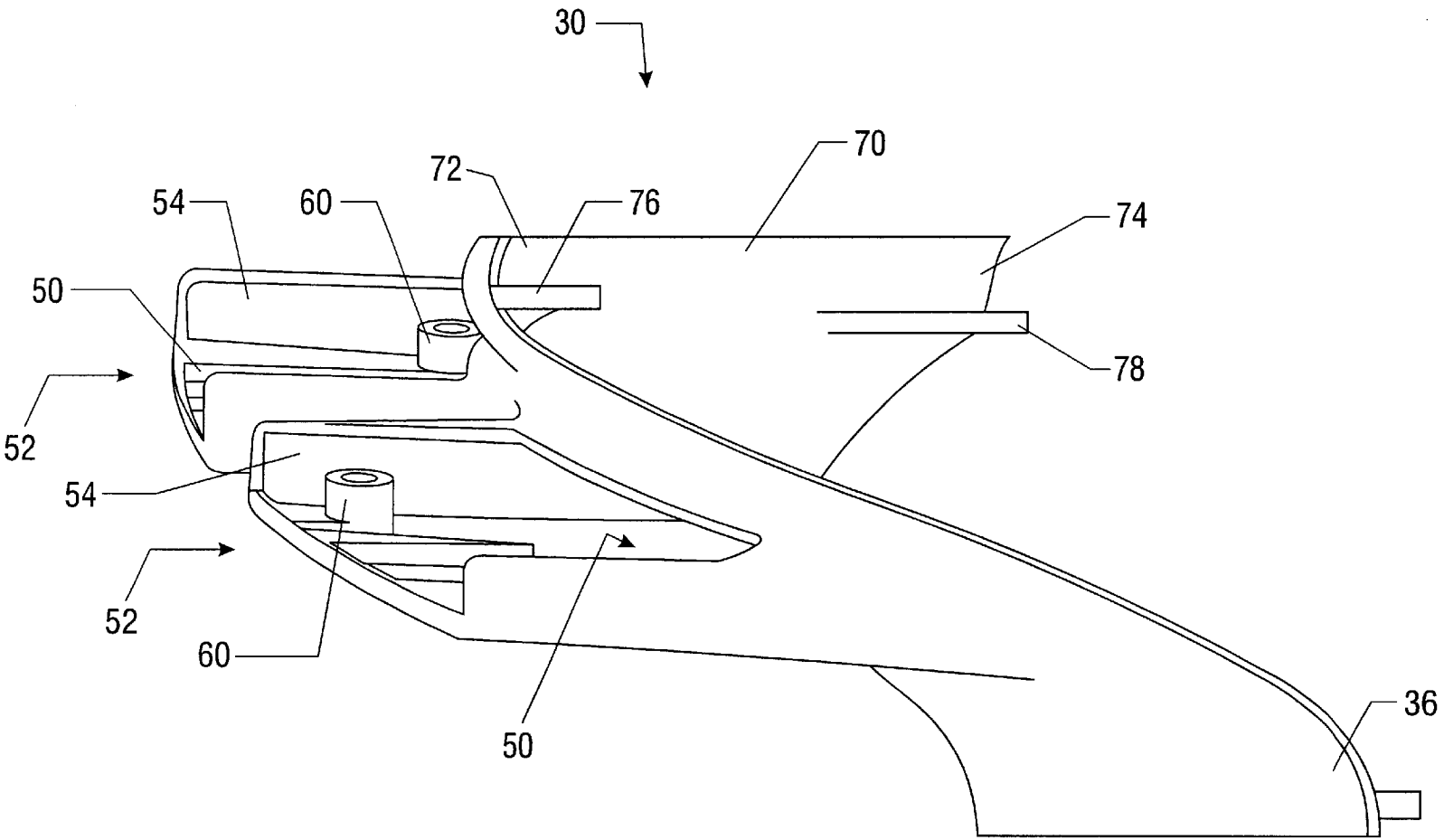
FIG. 5 is a perspective view of an embodiment of a blade holder in accordance with the present invention.

The ceiling fan 10 of the present invention additionally includes a novel blade holder 30, an embodiment of which is illustrated in FIG. 5. As discussed above, the blade holder 30 includes a lower portion 36 which is coupled to the hub 26. The blade holder 36 defines a ledge 50, to which the fan blade 28 attaches such that the fan blade 28 extends radially from the hub 26. The exemplary ceiling fan 10 embodiment of FIG. 2, FIG. 3 and FIG. 4 includes the split-blade design as discussed above. Thus, as pictured in FIG. 5, two ledges 50 extend from the blade holder 30, each ledge 50 forming the floor of a channel 52 which includes two side walls 54 in a spaced relationship extending generally perpendicular to the floor 50. Each channel 52 receives one segment 56 (one side of the V-shaped cut out) of the fan blade 28.

The first end 32 of the fan blades 28 each define at least one bore 58 therethrough. The split-blade embodiment pictured herein includes two bores 58 extending through each blade segment 56. Each channel floor 50 may include at least one retaining member 60 extending upwards therefrom. The blade holder 30 embodiment of FIG. 5 includes four retaining members 60, each being generally cylindrical in shape, corresponding to the bores 58 through the fan blades 28. At least a portion of the retaining member 60 extends through the bore 58 in the fan blade segment 56 seated within the channel 52. A fastener such as a screw 62 extends through the bores 58 and into the retaining member 60 to fix the fan blade 28 within the channel 52. Alternate fastening methods may be employed, such as providing openings in the channel floor 50, either in lieu of the retaining members 60 or in conjunction therewith, wherein a bolt extends through the channel floor 50 and the blade 28 with a nut threaded thereabout.

Figure 6:
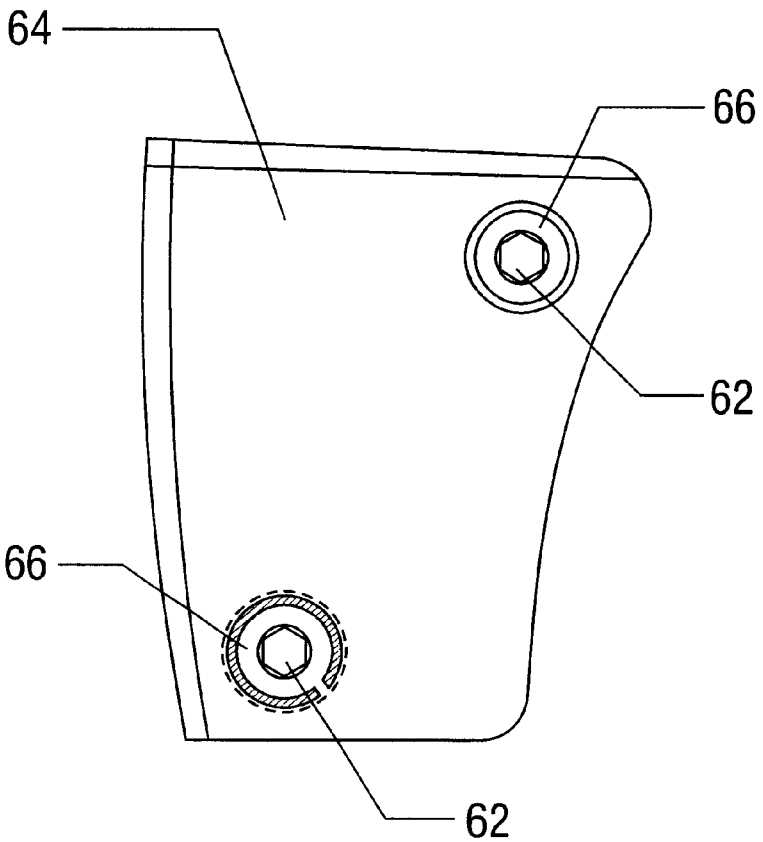
FIG. 6 illustrates an embodiment of a blade holder cover plate in accordance with the present invention.

A cover plate 64 may fit over the fan blade segment 56 such that it is sandwiched between the channel floor 50 and the cover plate 64. An embodiment of the cover plate 64 is illustrated in FIG. 6. The cover plate 64 further defines a bore 66 extending therethrough having an axis common to the bores 58 extending through the fan blades 28. The fastener 62 extends through the cover plate 64 and the fan blade 28, terminating in the retaining member 60 for fixing the fan blade 28 in its sandwiched position between the floor 50 and the cover plate 64. This configuration for fixing the fan blade 28 to the blade holder 30 is best illustrated in FIG. 3.

Figure 7:
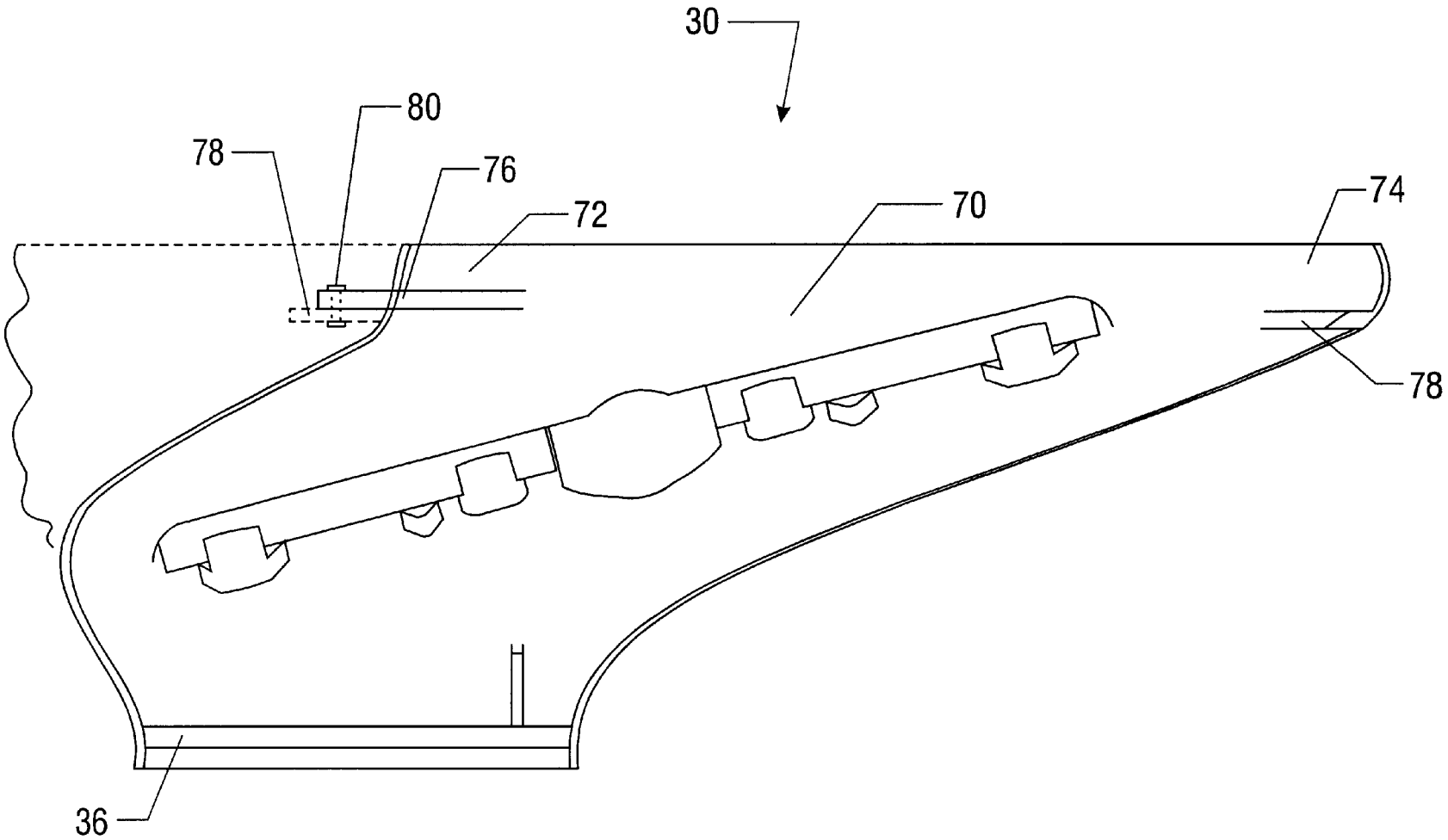
FIG. 7 illustrates a plan view of the embodiment of the blade holder shown coupled to an adjacent blade holder.

The blade holders 30 form an interlocking segment of a motor-concealing member 68 which rotates about the motor 12 with the hub 26. FIG. 7 shows an alternate view of the exemplary blade holder 30, which includes an upper portion 70 having first 72 and second 74 ends arranged such that the first end 72 of one blade holder 30 is coupled to the second end 74 of the adjacent blade holder. As shown in FIG. 5 and FIG. 7, each end 72 and 74 of the upper portion 70 defines a tab 76 and 78, respectively, extending therefrom, with one tab being positioned on a plane lower than the other, so that when adjacent blade holders are positioned in an abutting relationship, the tabs 76 and 78 overlap. A fastener 80 such as a nut and bolt or rivet couples the blade holders 30 together. Thus, the blade holders 30 having their upper portions 70 coupled together and their lower portions 36 coupled to the hub 26 form a dish-like member 68 which conceals the motor 12. The light light pan 42 may be positioned such that at least a portion of the light sockets 38 within the circumferential trough 46 are below the upper portion 70 such that the motor-concealing member 68 also rotates about the trough 46. The perspective view of the exemplary ceiling fan 10 shown in FIG. 2 best illustrates the motor-concealing member 68 formed by the adjoined blade holders 30.

The novel blade holders 30 of the invention provide several benefits. First, the blade holders 30 couple the fan blades 28 to the rotor 16 in a very robust manner. Known ceiling fans typically use a flange having one end to which a fan blade is attached with bolts or screws, with the opposite end bolted to the fan's rotor. In contrast, the novel blade holder 30 of the present invention uses the combination of the channel 52 and cover plate 64 to "surround" the fan blade 28 and hold it securely in place.

Next, the blade holder lower portions 36 are coupled to the hub 26, and the upper portions 70 are each coupled to the adjacent blade holder, forming an integral unit 68.

The upper portion 70 and the lower portion 36 each form a concentric ring, which provides better balance for the fan blades. A common problem with known ceiling fans is the "wobble" caused by unbalanced blades. This problem is greatly reduced in a ceiling fan employing blade holders 30 in accordance with the present invention.

Moreover, the combined blade holders 30 form a motor-concealing member 68 which rotates with the hub 26. This eliminates the need for a decorative motor housing, and the cost associated therewith. Additionally, the motor-concealing member 68 rotates about the motor 12, moving the air around the motor 12 and cooling it. Still further, in an exemplary embodiment, the light sockets 38 in the circumferential trough 46 are positioned such that at least a portion of the light bulbs 40 are located below the top plane of the motor concealing member 68. Thus, the rotating motor concealing member 68 also cools the light bulbs 40 within the circumferential trough 46. The circumferential trough 46 also further conceals the motor 12.

Thus, the novel ceiling fan 10 of the present invention provides an improved, integral up light feature which provides desired indirect lighting without requiring additional ceiling-clearance. Further, the blade holders 30 of the invention couple the fan blades 28 to the rotor 16 of the ceiling fan motor 12 in a stable, robust manner, which improves the ceiling fan's 10 balance. The motor-concealing member 68 with the fan blades 30 coupled thereto provides a single, integrated rotating unit which provides a sleek, low profile appearance and functions to cool the fan motor 12 and the up-light fixture, while eliminating the need to provide an additional, costly decorative motor housing.

The above description of exemplary embodiments of the invention are made by way of example and not for purposes of limitation. Many variations may be made to the embodiments and methods disclosed herein without departing from the scope and spirit of the present invention. Alternate embodiments are envisioned which include varying numbers and styles of fan blades. Other embodiments may include integral down-light fixtures. The present invention is intended to be limited only by the scope and spirit of the following claims.

What is claimed is:

1. A light fixture for a ceiling fan including a motor having a stator defining a top surface, a rotor having a plurality of blades attached thereto, the blades each having a distal end extending radially from the motor, the light fixture comprising:

a light pan coupled to the top surface of the stator, the light pan defining a circumferential trough;

a plurality of light sockets for engaging light bulbs, the sockets positioned within the trough;

wherein the fan blade distal ends define a horizontal plane, and wherein the trough is situated relative to the stator such that at least a portion of the light sockets are located below the horizontal plane of the fan blade distal ends.

2. The light fixture of claim 1 wherein the trough is situated relative to the stator such that the light sockets are located below a plane defined by the top surface of the stator.

3. A ceiling fan comprising:

a motor including a stator having an upper portion and a rotor having a lower portion, the rotor being rotatable with respect to the stator;

a hub coupled to the lower portion of the rotor so as to rotate therewith;

a motor-concealing member comprising a plurality of interlocking segments, each segment coupled to the hub such that the motor-concealing member rotates about the motor with the hub;

a plurality of fan blades, each fan blade having a first end;

at least one of the motor-concealing member segments comprising a blade holder defining at least one ledge, the first end of one of the fan blades being attached to the ledge such that the fan blade extends radially from the hub; and a plurality of light sockets coupled to the stator upper portion for engaging light bulbs, the light sockets being positioned such that at least a portion of light bulbs engaged in the light sockets are located below the motor- concealing member.

4. The ceiling fan of claim 3 wherein each of the motor-concealing member segments includes an upper portion and a lower portion, and wherein:

the lower portion of each segment is coupled to the hub; and the upper portion of each segment includes first and second ends arranged such that the first end of one segment is coupled to the second end of the adjacent segment.

5. The ceiling fan of claim 3 wherein the ledge of each blade holder forms a floor of at least one channel, each channel further including two side walls in a spaced relationship extending generally perpendicular to the floor, each channel being adapted to receive a segment of the first end of one of the fan blades.

6. The ceiling fan of claim 5 wherein:

each channel floor defines at least one retaining member extending upwards therefrom;

the first end of each fan blade defines at least one bore extending therethrough corresponding to the at least one retaining member, the bore adapted to receive at least a portion of the retaining member when the fan blade is seated within the channel; and the ceiling fan further comprises at least one fastener, each fan blade having one of the fasteners extending through the bore therein with the fastener terminating within the corresponding retaining member to fix the fan blade within the channel.

7. The ceiling fan of claim 6 further comprising:

at least one cover plate defining a bore extending therethrough;

the cover plate being situated over the fan blade such that the fan blade first end is sandwiched between the channel floor and the cover plate;

the bore extending through the cover plate having an axis common to the bore extending through the fan blade; and the fastener extending through the cover plate bore and through the fan blade bore into the retaining member to fix the fan blade in the sandwiched position between the cover plate and the channel floor.

8. The ceiling fan of claim 3 wherein the fan blade first end defines an opening therein such that the first end includes two segments, and wherein the at least one ledge comprises two ledges each adapted to receive one of the segments.

9. The ceiling fan of claim 3 wherein the sockets are configured such that the illumination from the light bulbs engaged therein projects above the fan blades.

10. The ceiling fan of claim 9 further comprising a light pan coupled to the upper portion of the stator with the sockets situated within the light pan.

11. The ceiling fan of claim 10 wherein the light pan defines a circumferential trough and wherein the sockets are positioned within the trough.

12. The ceiling fan of claim 11 wherein the stator defines a top surface, the top surface defining a plane, and wherein the trough is situated relative to the stator such that the light sockets are located below the plane of the top surface.

13. The ceiling fan of claim 11 wherein the fan blades each include a second end opposite the first end, the second ends defining a horizontal plane, and wherein the trough is situated relative to the stator such that at least a portion of the light sockets are located below the horizontal plane of the fan blade second ends.

14. The ceiling fan of claim 11 wherein the light sockets are situated such that at least a portion of the light sockets are below an upper portion of the motor concealing member.

15. The ceiling fan of claim 11 wherein the motor concealing member rotates about at least a portion of the light pan.

16. A light fixture for a ceiling fan including a top portion and a lower portion having a plurality of fan blades attached thereto, the fan blades each having a distal end extending radially from the lower portion, the light fixture comprising:

a light pan covering at least the top portion and defining a circumferential trough;

a plurality of light sockets for engaging light bulbs, the sockets being positioned within the trough; and wherein the fan blade distal ends define a horizontal palane, and wherein the trough is situated relative to the top portion such that at least a portion of the light sockets are located below the horizontal plane of the fan blade distal ends.

17. The light fixture of claim 16 wherein the top portion defines a top surface, the top surface defining a plane, and wherein the trough is situated relative to the top portion such that the light sockets are located below the plane defined by the top surface.

18. The light fixture of claim 16 wherein the sockets are configured such that the illumination from the light bulbs engaged therein projects above the fan blades.

19. A ceiling fan comprising:

a top portion;

a bottom portion adapted to rotate relative to the top portion;

a plurality of fan blades coupled to the bottom portion so as to rotate therewith, the fan blades each having a distal end extending radially from the bottom portion;

a light pan coupled to the top portion, the light pan defining a circumferential trough;

a plurality of light sockets for engaging light bulbs, the sockets positioned within the circumferential trough; and wherein the fan blade distal ends define a horizontal plane, and wherein the trough is situated relative to the top portion such that at least a portion of the light sockets are located below the horizontal plane of the fan blade distal ends.

20. The ceiling fan of claim 19 wherein the top portion defines a top surface, the top surface defining a plane, and wherein the trough is situated relative to the top portion such that the light sockets are located below the plane defined by the top surface.

21. The ceiling fan of claim 19 wherein the sockets are configured such that the illumination from the light bulbs engaged therein projects above the fan blades.

22. The ceiling fan of claim 19 wherein the fan blade distal ends define a horizontal plane, and wherein the trough is situated relative to the top portion such that at least a portion of the light sockets are located below the horizontal plane of the fan blade distal ends.

23. The ceiling fan of claim 19 further comprising a motor-concealing member having a plurality of interlocking segments, each segment coupled to the bottom portion such that the motor-concealing member rotates about the top portion.

24. The ceiling fan of claim 23 wherein the light bulbs engaged in the light sockets are situated such that at least a portion of the light bulbs are located below the motor-concealing member.

25. A ceiling fan comprising:

a top portion;

a bottom portion adapted to rotate relative to the top portion;

a plurality of fan blades coupled to the bottom portion so as to rotate therewith, the fan blades each having a distal end extending radially from the bottom portion;

a light pan coupled to the top portion, the light pan defining a circumferential trough;

a plurality of light sockets for engaging light bulbs, the sockets positioned within the circumferential trough; and wherein the fan blade distal ends define a horizontal plane, and wherein the trough is situated relative to the top portion such that at least a portion of the light sockets are located below the horizontal plane of the fan blade distal ends.

26. A ceiling fan comprising:

a motor including a stator having an upper portion and a rotor having a lower portion, the rotor being rotatable with rcspcct to the stator;

a hub coupled to the lower portion of the rotor so as to rotate therewith;

a motor-concealing member comprising a plurality of interlocking segments, each segment coupled to the hub such that the motor-concealing member rotates about the motor with the hub;

a plurality of fan blades, each fan blade having a first end, the first end defining an opening therein such that the first end includes two segments;

at least one of the motor-concealing member segments comprising a blade holder defining two ledges, each ledge having a respective segment of the fan blade first end attached thereto such that the fan blade extends radially from the hub; and a plurality of light sockets coupled to the stator upper portion for engaging light bulbs.

27. A ceiling fan comprising:

a motor including a stator having an upper portion and a rotor having a lower portion, the rotor being rotatable with respect to the stator;

a hub coupled to the lower portion of the rotor so as to rotate therewith;

a plurality of interlocking segments coupled to the hub to form a dish-shaped motor concealing member extending around the motor to conceal the bottom and sides of the motor;

a plurality of fan blades, each fan blade having a first end;

at least one of the interlocking segments comprising a blade holder defining at least one ledge, the first end of one of the fan blades being attached to the ledge such that the fan blade extends radially from the hub; and a plurality of light sockets coupled to the stator upper portion for engaging light bulbs.

28. A blade-holding system for coupling fan blades to a ceiling fan, the ceiling fan including a motor having a rotating hub, the blade-holding system comprising:

a plurality of interlocking segments coupled to the hub to rotate therewith and to form a dish-shaped motor-concealing member for concealing the bottom and sides of the motor;

each motor-concealing member segment having an upper portion including first and second ends, the first end of each segment connected to the second end of an adjacent segment; and at least one of the motor-concealing member segments comprising a blade holder defining at least one ledge, the ledge being adapted to receive one end of a fan blade such that the fan blade extends radially from the hub.

* * * * *

UNITED STATES PATENT AND TRADEMARK OFFICE

CERTIFICATE OF CORRECTION

PATENT NO. : 6,247,894 B1
DATED : June 19, 2001
INVENTOR(S) : John Moody, Stanfield Young, David Lathrop It is certified that error appears in the above-identified patent and that said Letters Patent is hereby corrected as shown below:

Column 8,
Line 38, delete "palane" and insert -- plane --.

Signed and Sealed this

Eleventh Day of December, 2001

*Attest:*

Nicholas P. Godici

*Attesting Officer*

NICHOLAS P. GODICI
*Acting Director of the United States Patent and Trademark Office*